US008305318B2

(12) United States Patent
Ishiguchi

(10) Patent No.: US 8,305,318 B2
(45) Date of Patent: Nov. 6, 2012

(54) LIQUID CRYSTAL DISPLAY DEVICE AND ASSOCIATED METHOD FOR IMPROVING HOLDING CHARACTERISTICS OF AN ACTIVE ELEMENT DURING A VERTICAL BLANKING INTERVAL

(75) Inventor: Kazuhiro Ishiguchi, Kumamoto (JP)

(73) Assignee: Mitsubishi Electric Corporation, Tokyo (JP)

( * ) Notice: Subject to any disclaimer, the term of this patent is extended or adjusted under 35 U.S.C. 154(b) by 227 days.

(21) Appl. No.: 11/759,572

(22) Filed: Jun. 7, 2007

(65) Prior Publication Data

US 2007/0296661 A1 Dec. 27, 2007

(30) Foreign Application Priority Data

Jun. 27, 2006 (JP) ..... 2006-176084

(51) Int. Cl.
*G09G 3/36* (2006.01)

(52) U.S. Cl. ..... 345/94; 345/100

(58) Field of Classification Search ..... 345/87, 345/204, 205, 209, 98–100
See application file for complete search history.

(56) References Cited

U.S. PATENT DOCUMENTS

| | | | | |
|---|---|---|---|---|
| 6,064,363 | A | 5/2000 | Kwon | |
| 6,642,916 | B1 * | 11/2003 | Kodama et al. | 345/100 |
| 6,784,866 | B2 * | 8/2004 | Udo et al. | 345/100 |
| 6,842,200 | B1 * | 1/2005 | Su et al. | 349/38 |
| 2003/0076289 | A1 * | 4/2003 | Tokonami et al. | 345/100 |
| 2005/0042817 | A1 * | 2/2005 | Kawamura | 438/232 |
| 2005/0122321 | A1 | 6/2005 | Akai et al. | |
| 2006/0041805 | A1 * | 2/2006 | Song | 714/724 |
| 2006/0227092 | A1 * | 10/2006 | Nose | 345/98 |
| 2007/0046614 | A1 * | 3/2007 | Chien | 345/100 |

FOREIGN PATENT DOCUMENTS

| | | |
|---|---|---|
| JP | 5-313607 | 11/1993 |
| JP | 7-199866 | 8/1995 |
| JP | 9-212137 | 8/1997 |
| JP | 2001-515225 | 9/2001 |
| JP | 2002-40993 | 2/2002 |
| JP | 2003-173175 | 6/2003 |
| KR | 1998-076166 | 11/1998 |
| KR | 10-2005-0055595 | 6/2005 |

OTHER PUBLICATIONS

Notification of Reason(s) for Refusal issued Sep. 27, 2011 in Japanese Patent Application No. 2006-176084 (with Partial English translation).

Japanese Office Action issued Jan. 24, 2012, in Patent Application No. 2006-176084 (with English-language translation).

* cited by examiner

*Primary Examiner* — Chanh Nguyen
*Assistant Examiner* — Jonathan Blancha
(74) *Attorney, Agent, or Firm* — Oblon, Spivak, McClelland, Maier & Neustadt, L.L.P.

(57) ABSTRACT

A liquid crystal display device includes pixels, gate lines and source lines, active elements, a gate driver circuit, a source driver circuit, and a timing controller circuit. The source driver circuit conducts a prescribed operation of supplying the source signals of positive polarity and negative polarity having a prescribed voltage to the source lines during a vertical blanking interval, and electrically cutting the source lines off after the supply of the source signals while establishing a short circuit between adjoining source lines supplied with the source signals of opposite polarities, thereby causing the source lines to hold a prescribed DC voltage value.

10 Claims, 9 Drawing Sheets

LIQUID CRYSTAL DISPLAY DEVICE AND ASSOCIATED METHOD FOR IMPROVING HOLDING CHARACTERISTICS OF AN ACTIVE ELEMENT DURING A VERTICAL BLANKING INTERVAL

BACKGROUND OF THE INVENTION

1. Field of the Invention

The present invention relates to liquid crystal display devices and methods of driving the same and, in particular, to a liquid crystal display device including active elements and a method of driving the same.

2. Description of the Background Art

A description of the structure and the operating principles of a typical active matrix TFT (Thin Film Transistor) liquid crystal display device (hereafter simply called a liquid crystal display device) is provided. The liquid crystal display device has pixels arranged in a matrix on a translucent substrate, and gate lines and source lines interconnected to surround the pixels. Provided at the intersection of each gate line and each source line is a TFT, an active element, whose drain electrode is connected to a pixel. An opposed substrate is provided in an opposed position to the array substrate on which the pixels are formed. The opposed substrate and the array substrate have a liquid crystal interposed therebetween. The opposed substrate has opposed electrodes formed thereon, which are set to common potential. It may therefore be understood that the drain electrode of the TFT is connected to capacitance that is connected to the common potential of the opposed electrode. The liquid crystal capacitance is typically represented as $C_{LC}$. A storage capacitor $C_S$ is also formed in parallel to the liquid crystal capacitance $C_{LC}$ in the liquid crystal display device.

The gate lines are connected to a gate driver which is supplied with a start pulse STV and a vertical clock CLKV from a timing controller. The gate driver shifts the start pulse STV at timing of the vertical clock CLKV by a shift register, and level-shifts the contents of the shift register by an output buffer, to output desired gate potentials Vgh (gate-ON voltage) and Vgl (gate-OFF voltage). A gate line is selected once during one vertical interval, and the selected period is of almost the same length as one horizontal interval. The gate line is in an ON state during that period, and in an OFF state during the other periods.

The source lines are connected to a source driver. The source lines themselves have parasitic capacitance. The source driver is supplied with a start pulse STH, a data signal DATA, and a horizontal clock CLKH from the timing controller. With the start pulse STH as a reference point, the source driver captures the data signal DATA at timing of the horizontal clock CLKH successively and stores them in a shift data register. The source driver also subjects the value stored in the shift data register to D/A conversion by a D/A converter based on a latch signal LP supplied from the timing controller, and outputs it to the source lines via an output buffer.

When the data signal DATA is subjected to D/A conversion, a POL signal supplied from the timing controller is latched by the latch signal LP, and the output from the D/A converter has a voltage of positive polarity or negative polarity due to the polarity of the POL signal in the source driver. As well known, a liquid crystal deteriorates upon being kept applied with DC voltage, resulting in a fault such as image persistence. Therefore, the liquid crystal display device adopts a driving system of inverting the polarity of voltage applied to the liquid crystal at regular intervals.

One vertical period is the most commonly adopted polarity inversion period of a liquid crystal display device. Frame inversion of the entire screen having the same polarity is a spatial inversion method during one vertical period. With frame inversion, however, a subtle difference between positive-polarity applied voltage and negative-polarity applied voltage will be visually identified as flicker. Therefore, row-inversion drive with inversion at intervals of n rows, column-inversion drive with inversion at intervals of m columns, and n×m dot inversion drive with inversion at intervals of n rows and m columns, each of which has a fine same-polarity area spatially mixed, are widely adopted.

One vertical interval includes a vertical effective interval and a vertical blanking interval. The panel is scanned in a vertical direction during the vertical effective interval, and no gate line is selected during the vertical blanking interval. The source lines hold a potential written in the last line during the vertical blanking interval if left uncontrolled. A short vertical blanking interval presents no problem, but a long one has adverse effects such as described below.

A TFT does not completely become OFF and leaks to some extent when not selected. The amount of leakage depends on a drain-source voltage $V_{DS}$ of the TFT. Thus when the potential of a source line is at extremely high voltage during the vertical blanking interval, a pixel A written with a voltage of positive polarity approaches the extremely high voltage relatively gently, while a pixel B having the same gradation as the pixel A and written with a voltage of negative polarity approaches the extremely high voltage suddenly. With such change, the pixel A grows dark while the pixel B grows light (in normally white mode). When the image is a still image, the same thing occurs with opposite polarities in the next frame. That is, when the potential of a source line is at extremely low voltage during the vertical blanking interval, the pixel A written with a voltage of negative polarity grows dark while the pixel B written with a voltage of positive polarity grows light.

The above problem is caused by not only the TFT leakage but parasitic capacitance $C_{DS}$ across the drain and source. When the source lines are inverted at intervals of n rows, pixel potential varies constantly under the influence of the parasitic capacitance $C_{DS}$. Thus a pixel potential influenced by the potential of the last row is held during the vertical blanking interval, resulting in the same problem as described above.

The above problem causes a difference in shade between the pixels A and B, and also causes an effective DC component to be applied to the liquid crystal, which leads to liquid crystal deterioration. To reduce power consumption, the liquid crystal display device adopts a low frame frequency driving system in which an image is temporarily written and then held for a couple of vertical periods for a still image, for example. The low frame frequency driving system is adopted particularly for liquid crystal display devices intended for battery-driven mobile equipment. In a liquid crystal display device with the low frame frequency driving system, a blanking interval is significantly extended, which further encourages the above problem.

To address the problem, Japanese Patent Application Laid-Open Nos. 5-313607 (1993) and 2003-173 are proposed.

Japanese Patent Application Laid-Open No. 5-313607 adopts inversion drive of inverting voltage applied to source lines during a vertical blanking interval. This method, however, increases power consumption because the source lines need to be driven during the vertical blanking interval when they do not originally need to be driven. The method disclosed in JP 5-313607 thus cannot be adopted for a liquid crystal display device with the low frame frequency driving system for low power consumption.

Japanese Patent Application Laid-Open No. 2003-173 discloses a method of temporarily charging source lines to common potential after the start of a vertical blanking interval. This method is adaptable to the low frame frequency driving system. Yet this method requires a separate charging circuit which increases the circuit size.

SUMMARY OF THE INVENTION

It is an object of the present invention to provide a liquid crystal display device capable of improving the holding characteristics of an active element during a vertical blanking interval with low power consumption and without increasing the circuit size, and a method of driving the same.

In an aspect of the present invention, a liquid crystal display device includes pixels, gate lines and source lines, active elements, a gate driver circuit, a source driver circuit, and a timing controller. The pixels are arranged in a matrix on a translucent substrate. The gate lines and the source lines are provided in a corresponding manner to the pixels. The active element is at an intersection of each of the gate lines and each of the source lines, and has a drain electrode connected to the pixel. The gate driver circuit supplies a gate signal to the gate lines. The source driver circuit supplies a source signal to the source lines so that source signals having a positive polarity voltage relative to a common potential of the pixels and source signals having a negative polarity voltage are almost equal in number during one horizontal interval. The timing controller circuit supplies prescribed signals to the gate driver circuit and the source driver circuit to control the circuits. The source driver circuit conducts a prescribed operation of supplying the source signals of positive polarity and negative polarity having a prescribed voltage to the source lines during a vertical blanking interval, and electrically cutting the source lines off after the supply of the source signals while establishing a short circuit between adjoining the source lines supplied with the source signals of opposite polarities, thereby causing the source lines to hold a prescribed DC voltage value.

According to the liquid crystal display device of the present invention, the source driver circuit supplies the source signals of positive polarity and negative polarity having a prescribed voltage to the source lines during a vertical blanking interval, and electrically cuts the source lines off after the supply of the source signals while establishing a short circuit between adjoining the source lines supplied with the source signals of opposite polarities, thereby causing the source line to hold a prescribed DC voltage value. This increases the holding characteristics of the active element during the vertical blanking interval with low power consumption and without increasing the circuit size.

Another aspect of the present invention is directed to a method of driving a liquid crystal display device, the device including: pixels arranged in a matrix on a translucent substrate; gate lines and source lines provided in a corresponding manner to the pixels; an active element at an intersection of each of the gate lines and each of the source lines, the active element having a drain electrode connected to the pixel; a gate driver circuit supplying a gate signal to the gate lines; a source driver circuit supplying a source signal to the source lines so that source signals having a positive polarity voltage relative to a common potential of the pixels and source signals having a negative polarity voltage are almost equal in number during one horizontal interval; and a timing controller circuit supplying prescribed signals to the gate driver circuit and the source driver circuit to control the circuits. The method of driving the liquid crystal display device includes an output step, a short-circuit step, and a holding step. The output step supplies the source signals of positive polarity and negative polarity having a prescribed voltage to the source lines during a vertical blanking interval by the source driver circuit. The short-circuit step of electrically cuts the source lines off from the source driver circuit after the supply of the source signals while establishing a short circuit between adjoining the source lines supplied with the source signals of opposite polarities after the output step. The holding step causes the source lines to hold a prescribed DC voltage value after the short-circuit step.

According to the method of driving the liquid crystal display device of the present invention, the source signals of positive polarity and negative polarity having a prescribed voltage are supplied to the source lines during a vertical blanking interval, and the source lines are electrically cut off after the supply of the source signals while establishing a short circuit between adjoining the source lines supplied with the source signals of opposite polarities, thereby causing the source line to hold a prescribed DC voltage value. This increases the holding characteristics of the active element during the vertical blanking interval with low power consumption and without increasing the circuit size.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
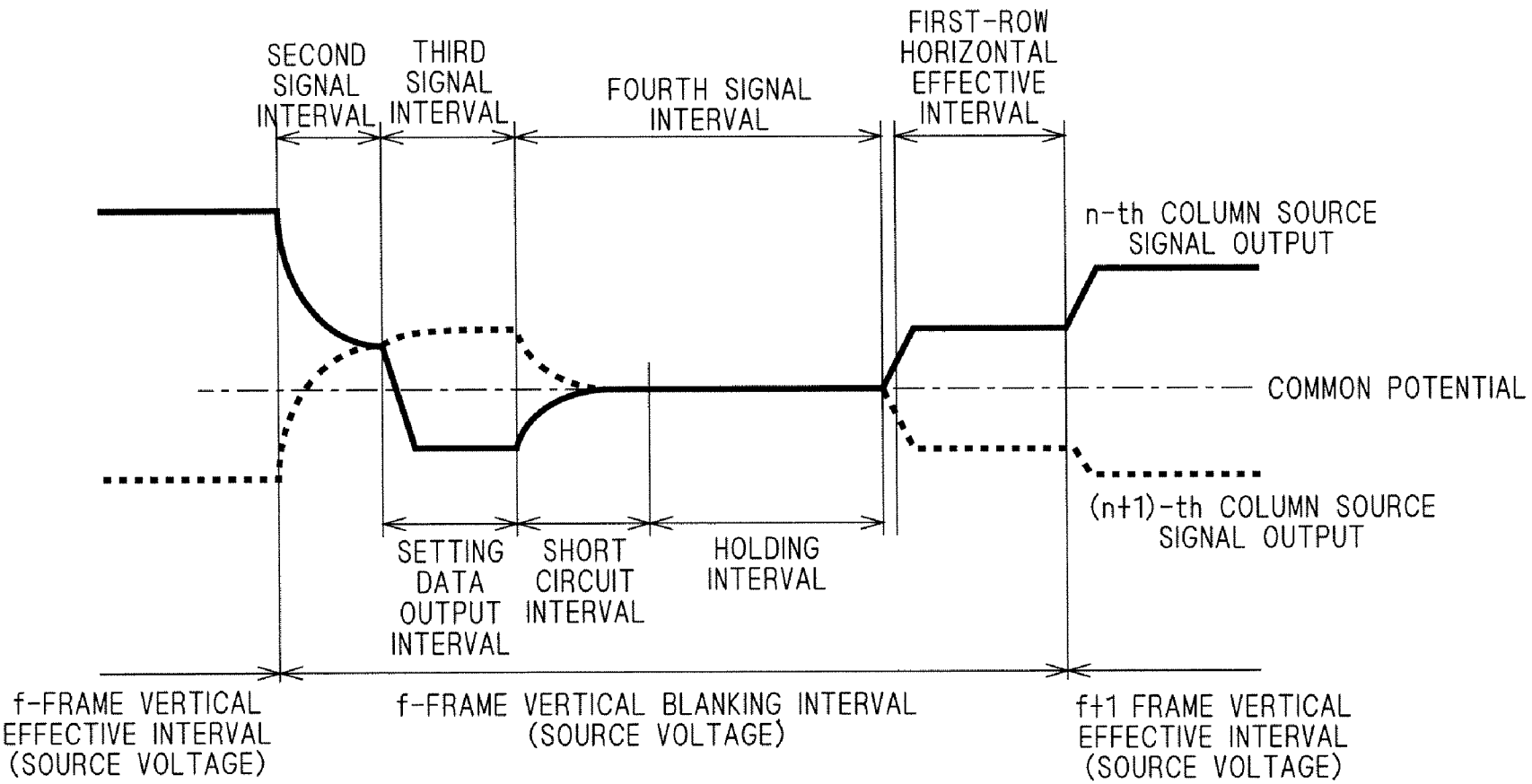
FIG. 1 shows potential variations in source line according to a first preferred embodiment of the present invention.
Figure 2:
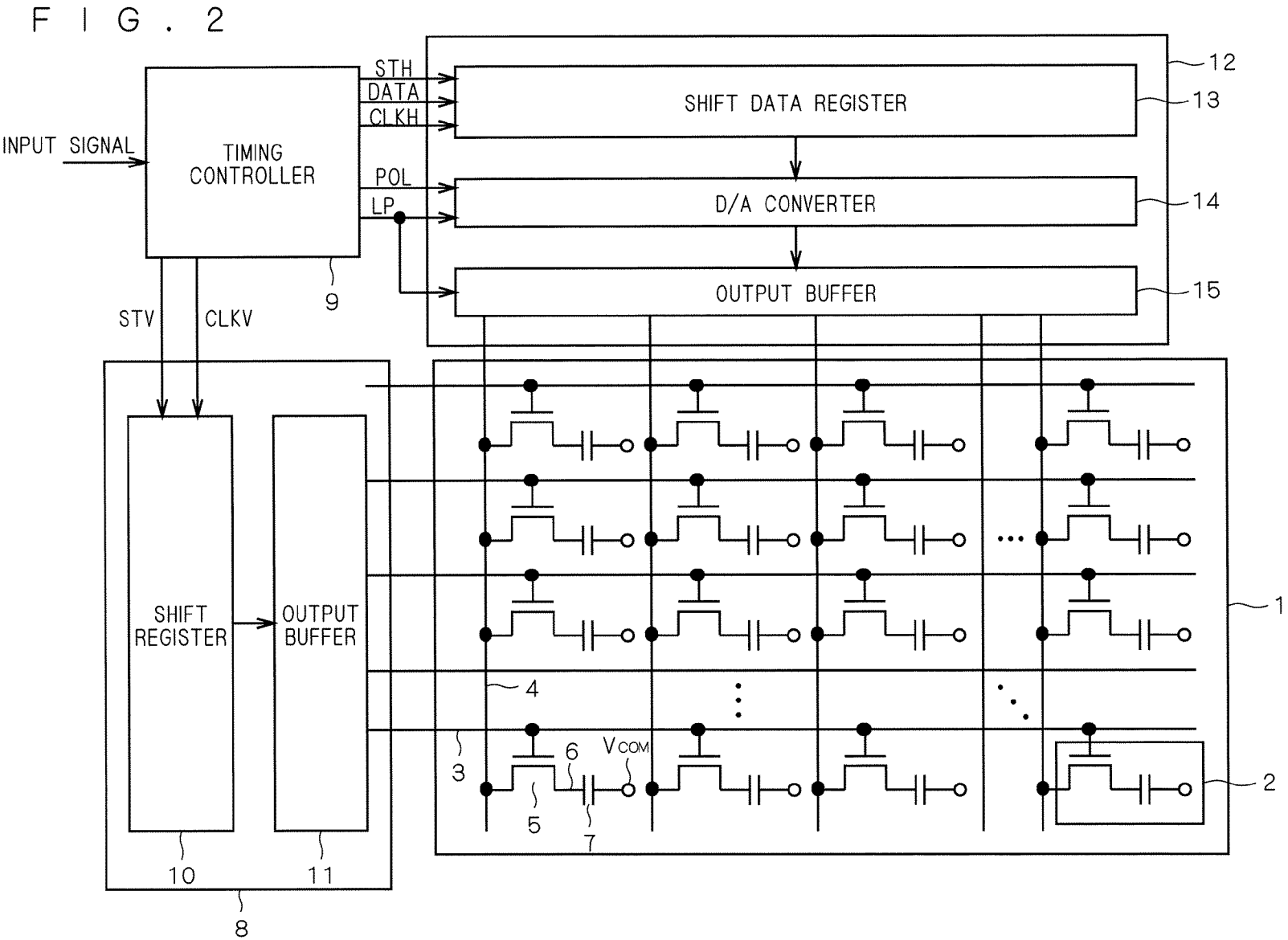
FIG. 2 is a block diagram of a liquid crystal display device according to the first preferred embodiment of the present invention.

FIG. 1 shows potential variations in source line of a liquid crystal display device according to a first preferred embodiment. FIG. 2 is a block diagram of the liquid crystal display device according to this embodiment. Referring to FIG. 2, the structure of the liquid crystal display device according to this embodiment is first described. The structure of a typical active matrix TFT liquid crystal display device may be used for the liquid crystal display device according to this embodiment.

The liquid crystal display device shown in FIG. 2 has pixels 2 arranged in a matrix on a translucent substrate 1, and gate lines 3 and source lines 4 interconnected to surround the pixels 2. Provided at the intersection of each gate line 3 and each source line 4 is a thin film transistor (TFT 5), an active element, whose drain electrode 6 is connected to a pixel element. An opposed substrate (not shown) is provided in an opposed position to the substrate 1 on which the pixels 2 are formed. The opposed substrate and the substrate 1 have a liquid crystal interposed therebetween, to form a liquid crystal panel. The opposed substrate has opposed electrodes formed thereon, which are set to common potential $V_{COM}$. Since a liquid crystal is a dielectric, it may be understood that capacitance 7 having one end connected to the common potential $V_{COM}$ of the opposed electrode is connected to the drain electrode 6 of the TFT 5.

Figure 3:
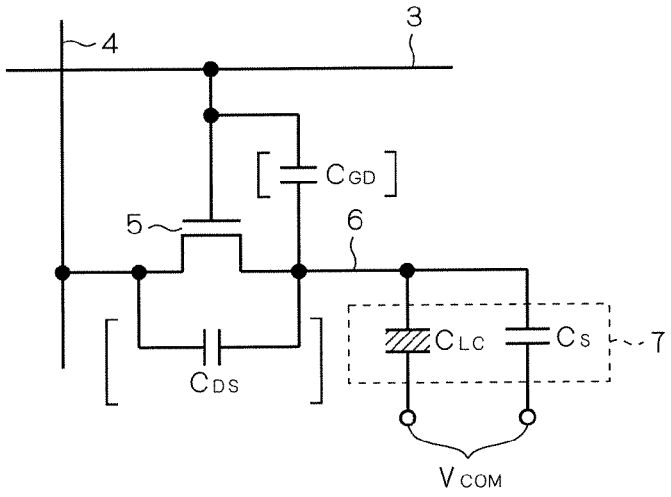
FIG. 3 is a circuit diagram of the liquid crystal display device according to the first preferred embodiment of the present invention.

FIG. 3 is a circuit diagram in the vicinity of the TFT 5. In FIG. 3, the capacitance 7 includes liquid crystal capacitance $C_{LC}$ and a storage capacitor $C_S$ in parallel to the liquid crystal capacitance $C_{LC}$. FIG. 3 also illustrates parasitic capacitance $C_{GD}$ generated across the gate and drain of the TFT 5, and parasitic capacitance $C_{DS}$ generated across the drain and source.

Referring back to FIG. 2, the gate lines 3 are connected to a gate driver 8 which is supplied with a start pulse STV and a vertical clock CLKV from a timing controller 9. The gate driver 8 shifts the start pulse STV at timing of the vertical clock CLKV by a shift register 10, and level-shifts the contents of the shift register 10 by an output buffer 11, to output desired gate potentials Vgh (gate-ON voltage) and Vgl (gate-OFF voltage).

The source lines 4 are connected to a source driver 12. The source lines 4 themselves have parasitic capacitance. The source driver 12 is supplied with a start pulse STH, a data signal DATA, and a horizontal clock CLKH from the timing controller 9. With the start pulse STH as a reference point, the source driver 12 captures the data signal DATA at timing of the horizontal clock CLKH successively and stores them in a shift data register 13. The source driver 12 also subjects the value stored in the shift data register 13 to D/A conversion by a D/A converter 14 based on a latch signal LP supplied from the timing controller 9, and outputs it to the source lines 4 via an output buffer 15. When the source driver 12 receives an analog signal, namely, when the data signal DATA is not a digital signal but an analog signal, the source driver 12 may have a sample-and-hold circuit instead of the shift data register 13, without a D/A converter.

When the data signal DATA is subjected to D/A conversion, a POL signal supplied from the timing controller 9 is latched by the latch signal LP, and the output from the D/A converter 14 has a voltage of positive polarity or negative polarity due to the polarity of the POL signal in the source driver 12.

Figure 4:
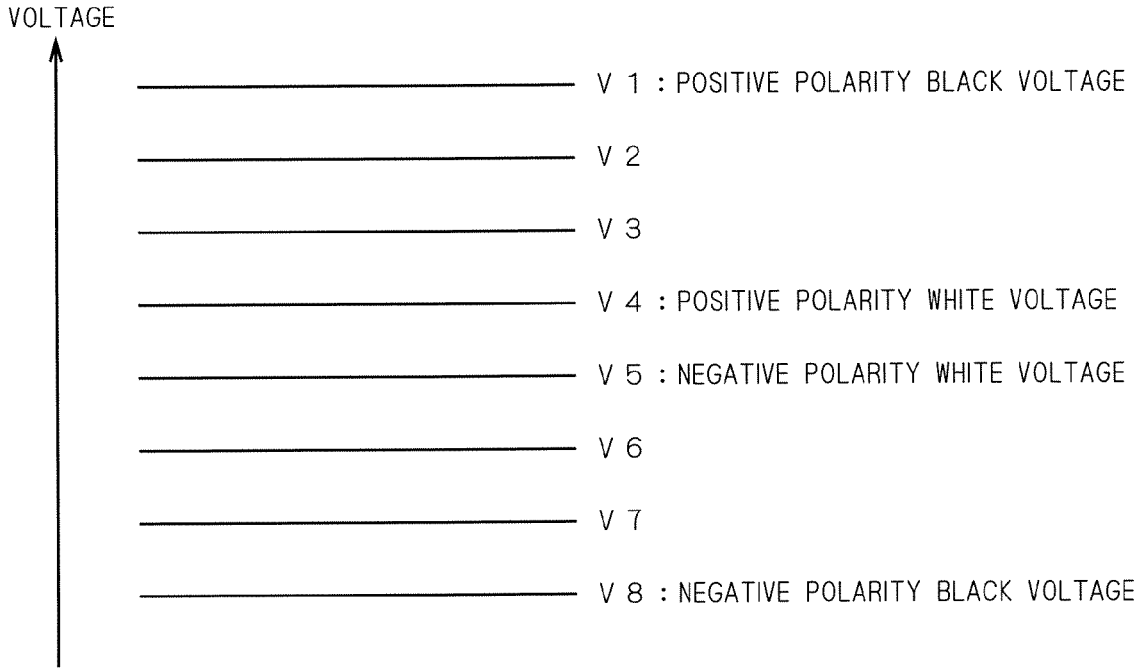
FIG. 4 is an illustration for explaining drive of the liquid crystal display device according to the first preferred embodiment of the present invention.

Drive of applying voltage of positive polarity or negative polarity to a liquid crystal is described. FIG. 4 is a schematic diagram of the order of voltage applied to a normally white (NW) liquid crystal. For brevity, it is assumed that a liquid crystal display device shown in FIG. 4 is capable of four-gradation display. The diagram is to be read by changing between black and white for a normally black (NB) mode. When common potential ($V_{COM}$) is set as an intermediate potential between voltages $V_4$ and $V_5$, a voltage applied to the liquid crystal is expressed as $V_n - V_{COM}$ (n=1 to 8). Accordingly, a positive voltage is applied to the liquid crystal with a voltage $V_n$ (n=1 to 4) of positive polarity, and a negative voltage is applied to the liquid crystal with a voltage $V_n$ (n=5 to 8) of negative polarity. An optical response of the liquid crystal, which is determined by the absolute value of the applied voltage, is of the same gradation with any of the combinations of n=(1, 8), (2, 7), (3, 6), and (4, 5). In short, applied voltages of these combinations are equal in absolute value.

Referring to FIG. 4, the aforementioned leakage of the TFT 5 is described. When the potential of the source line 4 is at the extremely high voltage $V_1$ during the vertical blanking interval, a pixel A written with the voltage $V_3$ of positive polarity approaches the voltage $V_1$ relatively gently, while a pixel B having the same gradation as the pixel A and written with the voltage $V_6$ of negative polarity approaches the voltage $V_1$ suddenly. With such change, the pixel A grows dark while the pixel B grows light (in normally white mode). When the image is a still image, the same thing occurs with opposite polarities in the next frame. That is, when the potential of the source line 4 is at the extremely low voltage $V_8$ during the vertical blanking interval, the pixel A at the voltage $V_6$ grows dark while the pixel B at the voltage $V_3$ grows light.

In this embodiment, the polarity of output from the source driver 12 is inverted at intervals of m lines, to drive the panel with n×m dot inversion or m-column inversion as a whole. Such structure can be attained by using a line-by-line inversion type source driver IC distributed most widely on the market. Further, the source driver 12 according to this embodiment has the function of neutralizing the charge accumulated in the source lines 4 by establishing a short circuit between outputs of different polarities. This is typically called charge sharing, a function of temporarily neutralizing the charge of the source line 4 charged to the opposite polarity in a row where the polarity applied to the liquid crystal changes, thereby suppressing power consumption for charging the source line 4.

Figure 5:
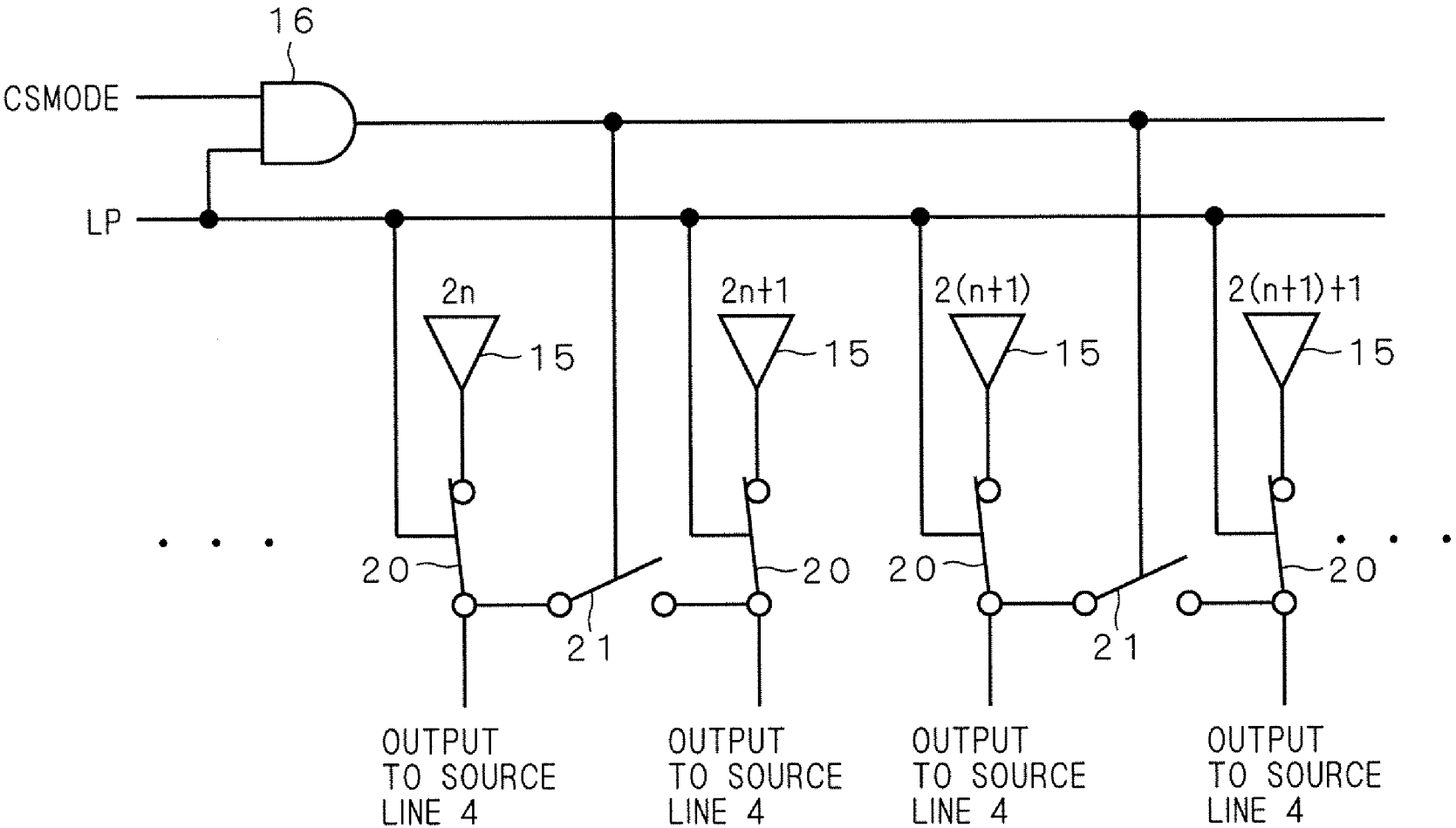
FIG. 5 is a circuit diagram of a source driver according to the first preferred embodiment of the present invention.

FIG. 5 illustrates an equivalent circuit in an output stage of the source driver 12 having the charge sharing function according to this embodiment. In the source driver 12 shown in FIG. 5, odd-numbered (2n+1, 2(n+1)+1) output buffers 15 and even-numbered (2n, 2(n+1)) output buffers 15 are opposite to each other in output polarity. In the latter stage of each of the output buffers 15, a normally closed switch (NCSW 20) that opens with the control signal (latch signal LP) being High is connected in series relative to the source line 4. Additionally, in the source driver 12 shown in FIG. 5, the latter stage of the odd-numbered (2n+1, 2(n+1)+1) output buffer 15 is connected to the latter stage of the even-numbered (2n, 2(n+1)) output buffer 15 with a normally opened switch (NOSW 21) that closes with a signal from an AND circuit 16 being High.

The NCSW 20 is controlled by the latch signal LP, and the NOSW 21 is controlled by the ANDed signal from the AND circuit 16 that receives the latch signal LP and a CSMODE signal. When the CSMODE signal is Low, the NOSW 21 connected between the output buffers 15 does not operate, thus not effecting charge sharing. At this time, when the latch signal LP to initiate D/A conversion (conversion starts on the leading edge) becomes High, the NCSW 20 is released to stop ineffective output during that interval. When the CSMODE signal is High, outputs of adjoining opposite polarities are shorted during an interval when the latch signal LP is High, thus neutralizing the charge in the source line 4.

The CSMODE signal may not be controlled from outside in some of the source driver ICs on the market. Yet the scope of the present invention will not be limited by the presence or absence of outside control of the CSMODE signal as long as the charge sharing function works.

Figure 6:
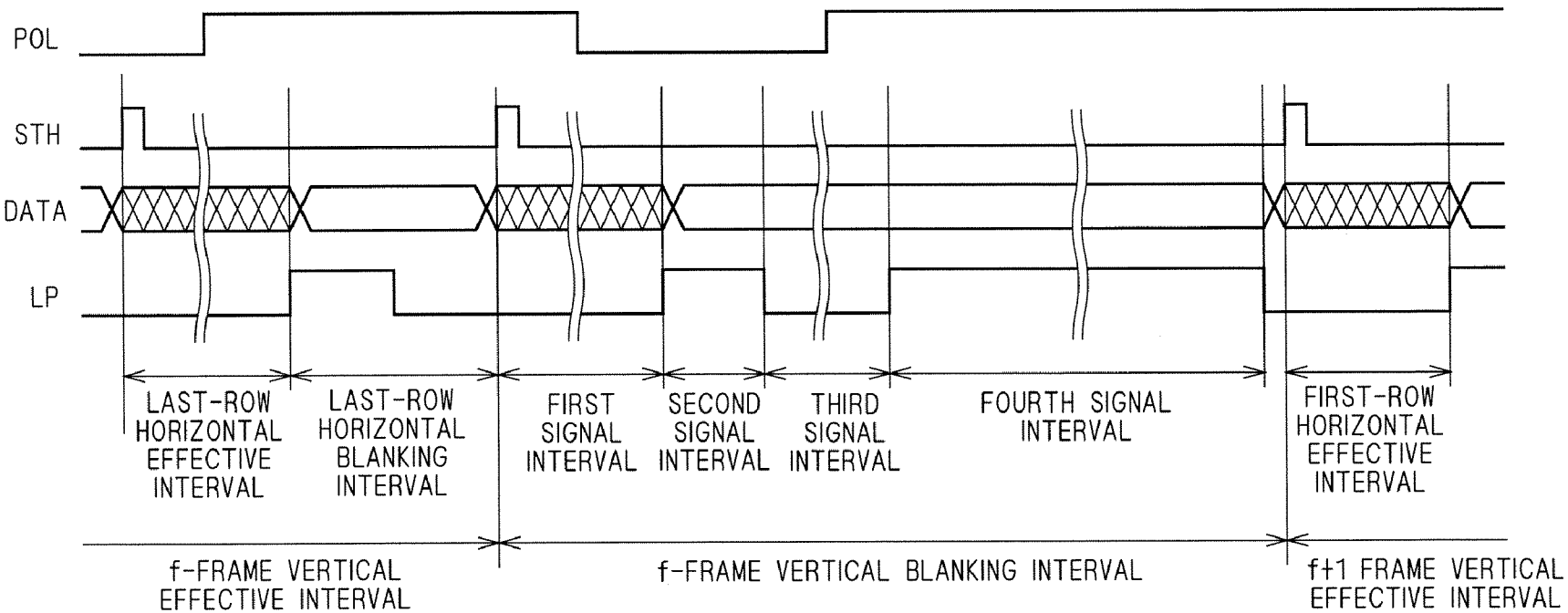
FIG. 6 is an illustration for explaining drive of the source driver according to the first preferred embodiment of the present invention.

Referring to FIG. 6, a control signal of the liquid crystal display device according to this embodiment is described. The CSMODE signal is not particularly illustrated in FIG. 6 because the present invention is viable even when there is no CSMODE signal that is controllable from outside, or when the CSMODE signal is controllable from outside and is dynamically controlled from the timing controller 9, or when the CSMODE signal is fixed to High.

In FIG. 6, the lateral axis represents time, and waveforms indicate waveforms of signals supplied to the source driver 12. An f-frame vertical effective interval on the left in FIG. 6 is a normal driving interval. During a last-row horizontal effective interval in the f-frame vertical effective interval, the data signal DATA of the last row is transferred to the source driver 12. The latch signal LP rises after the transfer to initiate D/A conversion. Upon fall of the latch signal LP, a desired voltage is output from the output buffer 15 to the source line 4. The other rows are subjected to the same process as the last row illustrated in FIG. 6.

Next, an f-frame vertical blanking interval shown in FIG. 6 has a first signal interval during which the data signal DATA is transferred to the source driver 12 as in the horizontal effective interval. The data signal DATA transferred during this interval is not based on an input signal to the timing controller 9, but is separately prescribed data described later. The f-frame vertical blanking interval then has a second signal interval during which the latch signal LP becomes High to initiate D/A conversion.

The f-frame vertical blanking interval subsequently has a third signal interval during which the latch signal LP becomes Low to output the D/A converted data to the source line 4. The f-frame vertical blanking interval has a fourth signal interval after that during which the latch signal LP becomes High and is held until immediately before the start of the next frame (f+1). The POL signal and the start pulse STH are also illustrated in FIG. 6.

Referring to FIG. 1, a description is provided of potential variations in the source line 4 through drive during the f-frame vertical blanking interval shown in FIG. 6. Note that the potential variations in the source line 4 are delayed almost by a period that combines a horizontal effective interval and an interval during which the latch signal LP is High, relative to timing of the vertical effective interval and vertical blanking interval shown in FIG. 6. The reason for the delay is that the data signal DATA of the last row is actually output to the source line 4 upon fall of the latch signal LP that rose immediately after the completion of capturing the last data signal DATA, and that pixels are charged in the last row almost over one horizontal interval from the falling point of time. FIG. 1 depicts the f-frame vertical effective interval and the f-frame vertical blanking interval based on the potential of the source line 4, and is thus different from FIG. 6. To facilitate understanding, the f-frame vertical effective interval (source voltage) and the like are written on the lower portion in FIG. 1, with the corresponding signal intervals of FIG. 6 on the upper portion.

First, during the f-frame vertical effective interval, an output voltage corresponding to the data signal DATA of the last row is applied to the source line 4. Then, the latch signal LP becomes High to effect the charge sharing function (the CSMODE signal becomes High) during the second signal interval in the f-frame vertical blanking interval, thus neutralizing the charge in the source line 4. The potential of the source line 4 thus converges to an intermediate potential of the source line 4 potential held in the last row. By the time of transition to the second signal interval, all the gate lines 3 have entered an OFF state.

Then, the latch signal LP falls during the third signal interval, causing the data signal DATA having been transferred during the first signal interval in the f-frame vertical blanking interval to be D/A converted and output to the source line 4 (setting data output interval). Next, the latch signal LP becomes High during the fourth signal interval to effect the charge sharing function, causing the potential of an adjoining source line 4 charged up to that point to converge to an almost intermediate potential (short circuit interval). The converged intermediate potential is subsequently held (holding interval). It is assumed that the capacitance of the source line 4 is equal in any position. After the convergence, the charge sharing function may be terminated (by reducing the CSMODE signal to Low) to place the source line 4 in a floating state, or may be maintained. The result is the same with or without the termination of the charge sharing function, because two adjoining source lines 4 enter a floating state from the other portions.

A first-row horizontal effective interval of an f+1 frame starts subsequently, during which the source driver 12 temporarily reduces the latch signal LP to Low in preparation for capturing the next data signal DATA. The output buffer 15, in which data updated in the previous interval (first signal interval) remains, then outputs a voltage different only in polarity due to a change in the POL signal during the first-row horizontal effective interval. This operation may vary depending on the type of driver IC on the market.

At the completion of the first-row horizontal effective interval of the f+1 frame, a voltage corresponding to the data signal DATA captured during that interval is output to the source line 4 (start of an f+1 frame vertical effective interval of the source voltage). At this time, gates in the first row enter an ON state to initiate sequential scanning.

In the course of the processes of the first to fourth signal intervals as shown in FIG. 6 during the subsequent vertical blanking interval, the source voltage initially fluctuates to some extent, but can hold a constant DC voltage thereafter. In addition, no change is made during this interval to charge and discharge of the source line 4 or to the control signal. This means very little power consumption during the vertical blanking interval.

Meanwhile, with the use of the charge sharing function, the potential of the source line 4 after charge sharing is placed almost at midpoint of the potential of an adjoining source line 4 charged with voltage of a different polarity. Thus the potential during the holding interval shown in FIG. 1 (source holding potential) may be set to the common potential by calculating the data signal DATA written during the first signal interval backwards from the actually output voltage, using an expression of (positive polarity voltage+negative polarity voltage)/2=common potential. With commonly available source driver ICs having gradation resolution from 1/63 to 1/255, the selection of an optimum combination of voltages from a variety of combinations allows the source holding potential to be set to the common potential with considerably high accuracy.

The setting of a voltage of positive polarity and negative polarity to be output during the vertical blanking interval may be specifically made by using data stored in a non-volatile memory in the timing controller 9 or data supplied from an external setting port and the like as gradation data to be output during that interval.

When the vertical blanking interval is significantly long, the potential of the source line 4 in a floating state from the other portions may vary due to leak current. In such a case, the first to fourth signal intervals shown in FIG. 6 are conducted several times during the vertical blanking interval, thus supplying a prescribed data signal DATA regularly to the source driver 12 to maintain the source holding potential.

A detailed description is now provided about where to set the source holding potential. While the TFT 5 is OFF, holding potential of the corresponding pixel 2 (pixel holding potential) fluctuates in slightly different ways depending on components of leakage from the TFT 5 and other parts, and components from the parasitic capacitance $C_{DS}$.

Figure 7:
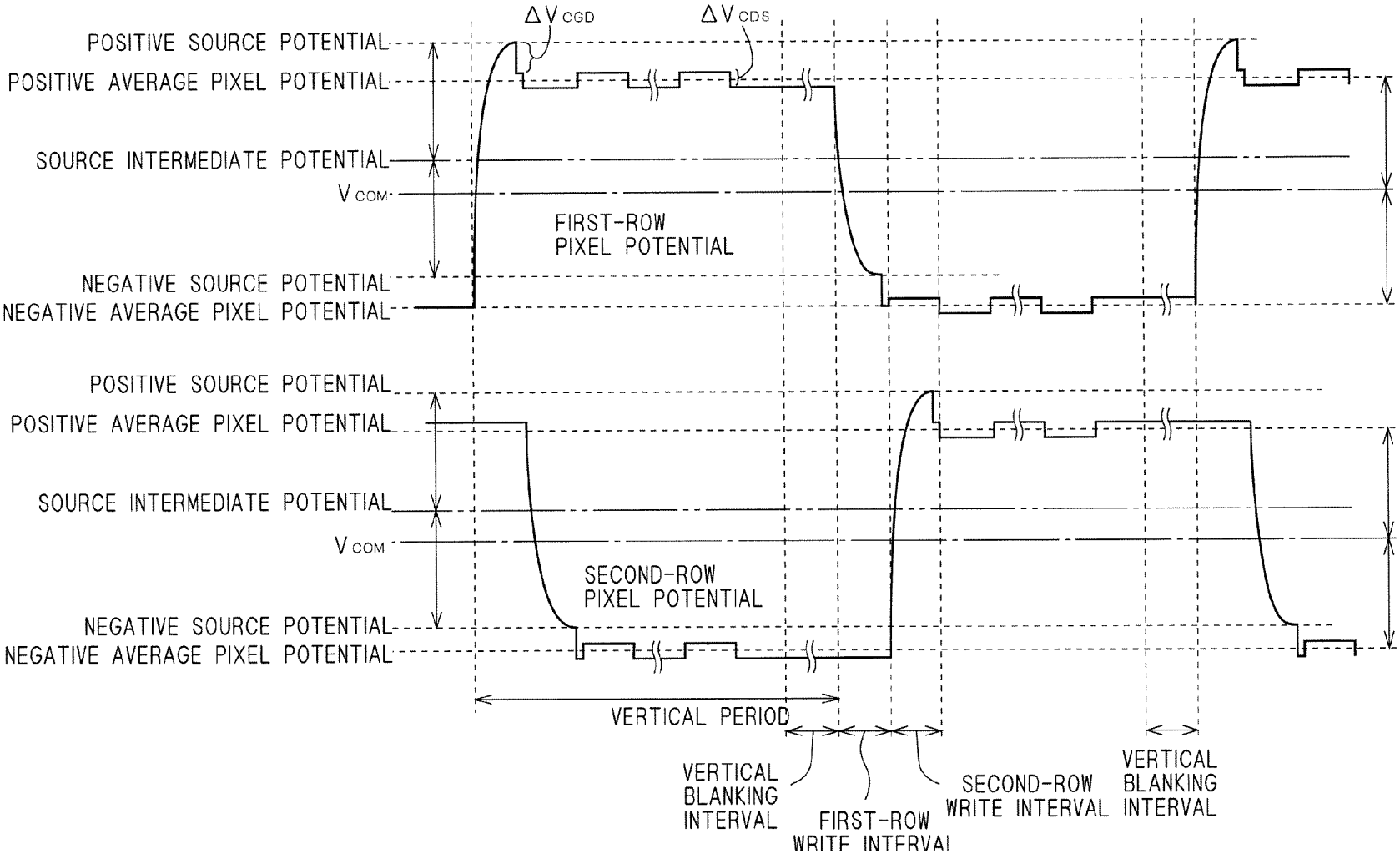
FIG. 7 is an illustration for explaining pixel holding potential according to the first preferred embodiment of the present invention.
Figure 8:
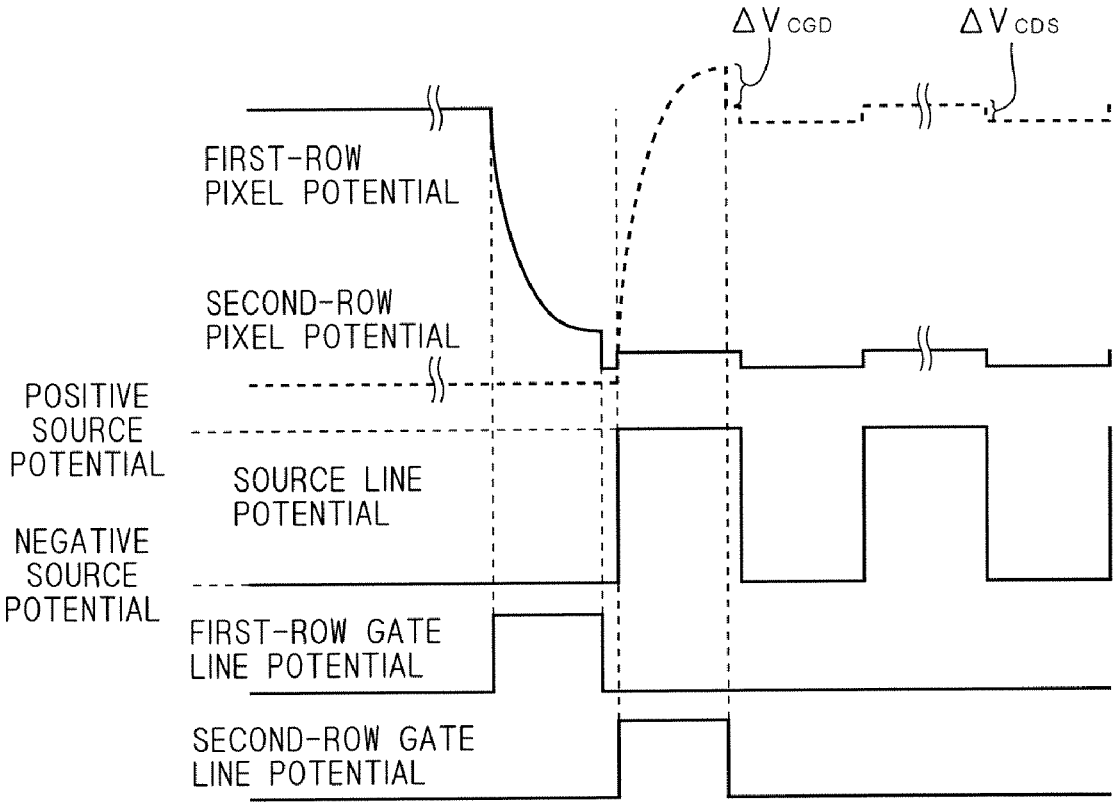
FIG. 8 is an illustration for explaining drive of the liquid crystal display device according to the first preferred embodiment of the present invention.

The first case is when the TFT 5 and other parts do not leak at all and only the components from the parasitic capacitance $C_{DS}$ have an influence. FIGS. 7 and 8 illustrate fluctuations in pixel holding potential according to this embodiment. The upper graph of FIG. 7 is directed to the pixel holding potential in a first row of a certain column, and the lower graph is directed to the pixel holding potential in a second row of the same column as the upper graph. FIG. 8 shows parts of the pixel holding potentials in the first and second rows that are superimposed, with corresponding gate line potentials.

It is assumed with respect to the source lines shown in FIG. 7 that polarity is inversed row by row and an image displayed is a raster image having some kind of gradation (the entire screen having the same gradation). It is also assumed that a vertical blanking interval is not particularly conducted, and the data signal DATA in the last row is kept output.

Referring to FIGS. 7 and 8, when a gate in the first row opens, the corresponding TFT 5 enters an ON state, causing the pixel 2 to be charged up to a positive source potential. At this time, the pixel holding potential converges to the positive source potential smoothly with a time constant depending on the mobility of the TFT 5. When the gate is then turned off, the pixel holding potential decreases due to AC coupling to the gate potential under the influence of the parasitic capacitance $C_{GD}$. The decreased voltage is generally called feed-through voltage ($\Delta V_{CGD}$). Subsequently, since the TFT 5 of the pixel 2 in the first row is in an OFF state, the pixel electrode is in a floating state in terms of direct current (because of the assumed no leakage).

However, due to components of the structural capacitance from the source line 4 arranged next to the pixel 2 and the parasitic capacitance $C_{DS}$ of the TFT 5, the pixel 2 undergoes potential fluctuation ($\Delta V_{CDS}$) in proportion to the change in the source line 4. An average potential $V_{AVEn}$ of a pixel in an "n-th" row during one vertical period at this time can be expressed as the following equation 1 which excludes an average in the written row for brevity of calculation. For a liquid crystal display device having the total number of rows of approximately several hundreds to a thousand, the written row has an influence of approximately 1/the total number of rows, and is therefore negligible.

$$V_{AVEn} = V_{sn} - \Delta V_{CGD} + \frac{k}{T_V}\sum_i \Delta V_{CDS}\Delta T_i = V_{sn} - \Delta V_{CGD} + \frac{k}{T_V}\sum_i (V_{si} - V_{sn})\Delta T_i \quad \text{[Equation 1]}$$

The sign i in the equation 1 represents an index of a position where the source line fluctuates other than the "n-th" row. The equation 1 adds up influences of source potential fluctuations in the position other than the "n-th" row over one vertical period. The sign $V_{sn}$ represents the source potential in a position of the "n-th" row, the sign k represents a constant obtained by dividing the parasitic capacitance $C_{DS}$ by the total capacitance of the pixel other than the parasitic capacitance $C_{DS}$, the sign $T_V$ represents the vertical period, and the sign $\Delta T_i$ represents time during which source potential in the "i-th" row is constant. With the assumption that the entire screen has the same gradation with no vertical blanking interval, and an average voltage of pixels written with positive polarity is represented as $V_{AVE+}$ and an average voltage of pixels written with negative polarity is represented as $V_{AVE-}$, the equation 1 can be written as the following equation 2:

$$V_{AVE+} = V_{s+} - \Delta V_{CGD} + \frac{k}{2}(V_{s-} - V_{s+}) = V_{s+} - \Delta V_{CGD} - \frac{k}{2}(V_{s+} - V_{s-}) \quad \text{[Equation 2]}$$

$$V_{AVE-} = V_{s-} - \Delta V_{CGD} + \frac{k}{2}(V_{s+} - V_{s-})$$

The sign $V_{S+}$ in the equation 2 represents a positive source potential, and the sign $V_{S-}$ represents a negative source potential. Also in the equation 2, the numbers of changes in positive polarity and negative polarity other than the written row are almost equal and are thus approximated.

The first term on the right side of the equation 2 represents charging potential to the source line, and the second term represents a reduction by the same feed-through voltage ($\Delta V_{CGD}$) with both positive and negative polarities. The third term on the right side of the equation 2 indicates that positive polarity renders the potential negative to reduce the average voltage of the pixel, and negative polarity renders the potential positive to increase the average voltage of the pixel, thus reducing amplitude (pixel applied voltage). The equation 2 shows that the common potential $V_{COM}$ is at midpoint between the positive source potential $V_{S+}$ and the negative source potential $V_{S-}$. The common potential $V_{COM}$ is thus set to a potential reduced by the feed-through voltage ($\Delta V_{CGD}$) from a source intermediate potential shown in FIG. 7. The equation 2 further shows that, in consideration of the amplitude reduction in the third term on the right side of the equation 2, the amplitude of the positive source potential $V_{S+}$ and the negative source potential $V_{S-}$ should be set to a value that can obtain desired gradation.

Next, the source holding potential during the vertical blanking interval is described. Assuming that the sign $T_B$ represents the vertical blanking interval and the sign $V_{SB}$ represents the source holding potential during that interval, average potentials of positive polarity and negative polarity can be expressed as the following equation 3:

$$V_{AVE+} = V_{s+} - \Delta V_{CGD} - \frac{k}{2}(V_{s+} - V_{s-}) + \frac{k}{T_V}(V_{SB} - V_{s+})T_B \quad \text{[Equation 3]}$$

$$V_{AVE-} = V_{s-} - \Delta V_{CGD} + \frac{k}{2}(V_{s+} - V_{s-}) + \frac{k}{T_V}(V_{SB} - V_{s-})T_B$$

When the vertical blanking interval $T_B$ is long as in the low frame frequency driving system, a fourth term component on the right side of the equation 3 increases and becomes non-negligible. Although the influence of the fourth term should be reduced by setting the fourth term to zero, no source holding potential $V_{SB}$ exists that becomes zero relative to both the positive source potential $V_{S+}$ and the negative source potential $V_{S-}$. If potentials fluctuate by the same amount with opposite polarities, the amplitude changes but the amounts of change become equal. This cancels out a DC component (deviation of amplitude) applied to the liquid crystal, thereby improving image persistence. The conditions of such source holding potential $V_{SB}$ are expressed as the following equation 4, which is an intermediate potential of source amplitude.

$$V_{SB} = \frac{V_{s+} + V_{s-}}{2} \quad \text{[Equation 4]}$$

It is understood from the above that with no leakage from the TFT 5 and other parts, the source holding potential during the vertical blanking interval should be set to an intermediate potential of source amplitude.

The second case is when the TFT 5 and other parts leak. Conversely, this case is assumed to be under no influence at all of the parasitic capacitance $C_{DS}$. The leak components of the TFT 5 and other parts are roughly divided into those that leak to the common potential via the liquid crystal itself, and those that leak via the drain electrode 6 of the TFT 5. For brevity, those that leak to the common potential via the liquid crystal itself are regarded as resistance $R_{LC}$, and those that leak via the drain electrode 6 of the TFT 5 are regarded as resistance $R_{DS}$ in this embodiment.

When the vertical blanking interval is infinitely long, the resistance $R_{LC}$ and the resistance $R_{DS}$ are connected in series between the common potential $V_{COM}$ and the source holding potential $V_{SB}$ during the vertical blanking interval, causing the source holding potential $V_{SB}$ to converge to a voltage divided by the respective resistances. A time response of the convergence in such simple discharge circuit can be simply calculated by the magnitude of each resistance and the total capacitance of the pixel 2, the common potential $V_{COM}$, and the source holding potential $V_{SB}$.

Thus when the source holding potential $V_{SB}$ is different from the common potential $V_{COM}$, the potentials of pixels connected to the same source line 4 after the lapse of the infinite time assume positive polarity or negative polarity different from the common potential $V_{COM}$.

If the source holding potential $V_{SB}$ is set to the aforementioned source intermediate potential under the influence of the parasitic capacitance $C_{DS}$, the source holding potential $V_{SB}$ is set higher than the common potential $V_{COM}$ by the feed-through voltage ($\Delta V_{CGD}$). The result is that the source holding potential $V_{SB}$ constantly deviates to positive polarity potential during the vertical blanking interval, resulting in image persistence and the like. In view of only the leak components, it is ideal for the source holding potential $V_{SB}$ to be set to the common potential $V_{COM}$.

As described above, a value required for the source holding potential $V_{SB}$ varies depending on the parasitic capacitance $C_{DS}$ components and leak components. Specifically, the source holding potential $V_{SB}$ should be calculated to avoid deviation of average pixel potential based on the relationship between the resistance $R_{LC}$, the resistance $R_{DS}$, the parasitic capacitance $C_{DS}$, the parasitic capacitance $C_{GD}$, the vertical period, and the vertical blanking interval. Although not easy algebraically, an optimum source holding potential $V_{SB}$ can be readily obtained by numerical calculation using a circuit simulator such as SPICE. Without a circuit simulator, an optimum source holding potential $V_{SB}$ may be determined by making fine adjustments with actual equipment based on the degree of image persistence and flicker. The resulting optimum source holding potential $V_{SB}$ takes on a value in a range between the source intermediate potential and the common potential.

In the liquid crystal display device according to this embodiment, a signal is supplied from the timing controller 9 to the source driver 12 in a manner that allows the source potential to be controlled to any DC potential almost the entire time during the vertical blanking interval with a commonly available source driver IC having the charge sharing function. Therefore, a unique image can be obtained regardless of the source potential in the last row, and power consumption is reduced because the panel is driven with little power during the vertical blanking interval. This embodiment is thus adaptable enough to the low frame frequency driving system.

Second Preferred Embodiment

In a typical liquid crystal display device, gate lines are driven by a gate driver provided on one side of the gate lines. The waveform of a gate signal thus becomes steep in the vicinity of the input side of a gate line, and becomes gradual with increasing distance from the input side due to the resistance and parasitic capacitance of the gate line. In a liquid crystal display device in which gate lines are driven by gate drivers provided on both sides of the gate lines, the waveform of a gate signal becomes gradual in the vicinity of the center of a gate line when compared to the vicinity of the input side.

The gradual waveform of a gate signal causes the gate signal to vary in a horizontal direction (gate line direction) of the liquid crystal display device. The gate signal variations cause the feed-through voltage ($\Delta V_{CGD}$) of a source potential to vary in the horizontal direction of the liquid crystal display device. More specifically, when the waveform of a gate signal is steep, the feed-through voltage ($\Delta V_{CGD}$) resulting from the parasitic capacitance $C_{GD}$ cannot be raised to the source potential by charge movement via the TFT over a period of time during which the TFT is in an ON state and starts to become OFF. Namely, pixel potential cannot be raised to the source potential by drain current of the TFT because the period of time during which the TFT is in an ON state and starts to become OFF is short. A feed-through voltage ($\Delta V_{CGD}$) generated is thus proportionate to an ON voltage Vgh of the gate—an OFF voltage Vgl of the gate (the proportionality coefficient is a value obtained by dividing the parasitic capacitance $C_{GD}$ by the total capacitance of the pixel other than the parasitic capacitance $C_{GD}$).

When the waveform of a gate signal is gradual, on the other hand, pixel potential can be raised to some extent toward the source potential by drain current of the TFT even with the generation of a feed-through voltage ($\Delta V_{CGD}$) because a period of time during which the TFT is in an ON state and starts to become OFF is long. The feed-through voltage ($\Delta V_{CGD}$) is thus smaller in a position of the gradual gate signal waveform than in a position of the steep gate signal waveform.

The aforementioned phenomenon means variations in an ideal common potential of a pixel in the horizontal direction of the liquid crystal display device, which contributes to the generation of flicker, image persistence and the like.

As described in the first preferred embodiment, potential applied to a source line can be set to any potential during the vertical blanking interval in the present invention. This allows the source holding potential during the vertical blanking interval to vary source line by source line or in units of groups of source lines, in the horizontal direction of the liquid crystal display device. The group of source lines refers to a unit of a plurality of source lines divided so that source lines supplied with positive polarity voltage and source lines supplied with negative polarity voltage are almost equal in number.

Figure 9:
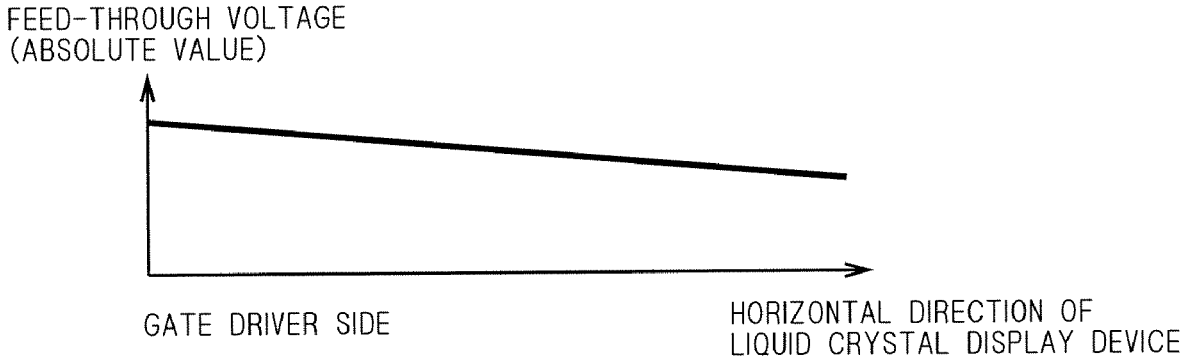
FIG. 9 is an illustration for explaining fluctuations in feed-through voltage according to a second preferred embodiment of the present invention.

To provide a detailed description, it is assumed that the absolute value of the feed-through voltage ($\Delta V_{CGD}$) varies in such a way as shown in FIG. 9 in the horizontal direction of the liquid crystal display device. Since the feed-through voltage ($\Delta V_{CGD}$) acts to reduce pixel potential, the absolute value of the feed-through voltage ($\Delta V_{CGD}$) decreases and the pixel potential increases in a distant position from the gate driver. The amplitude thus increases on the positive polarity side and decreases on the negative polarity side in the distant position from the gate driver, resulting in deviation of a DC component.

Figure 10:
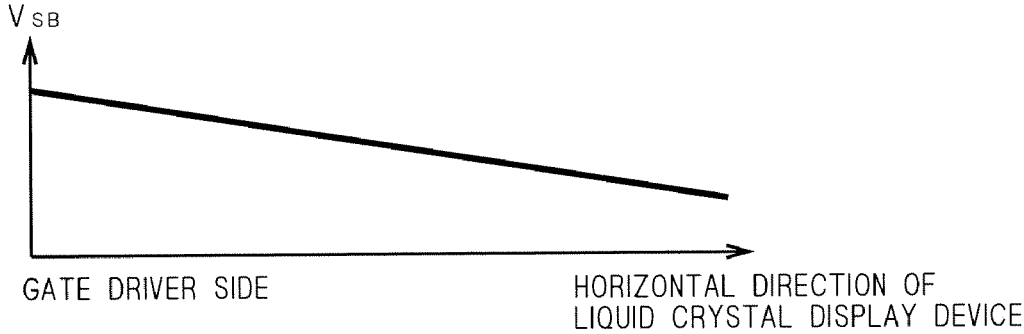
FIG. 10 is an illustration for explaining fluctuations in source holding potential according to the second preferred embodiment of the present invention.

In the liquid crystal display device according to this embodiment, the source holding potential $V_{SB}$ is caused to vary in such a way as shown in FIG. 10 during the vertical blanking interval in the horizontal direction of the liquid crystal display device. This causes the aforementioned average pixel potential to have positive correlation relative to the source holding potential $V_{SB}$ assuming that the parasitic capacitance $C_{DS}$, the parasitic leak resistance $R_{DS}$, and further the vertical period and the vertical blanking interval have constants. The pixel potential thus increases in the distant position from the gate driver. The pixel potential thus increases in a distant position from the gate driver. Therefore, the deviation of the DC component can be compensated by setting the source holding potential $V_{SB}$ in a manner that compensates for the aforementioned reduction of the feed-through voltage ($\Delta V_{CGD}$).

As a method for varying the source holding potential $V_{SB}$ in the horizontal direction of the liquid crystal display device, data to be applied source line by source line or in units of groups of source lines in the horizontal direction is written with predetermined voltage during the first signal interval shown in FIG. 6. Data of the predetermined voltage may be recorded beforehand in a non-volatile memory and the like and used or, when capacitance for holding data of all columns increases cost, may be recorded through discretization to some degree and used by linear interpolation and the like.

There is a type of source driver IC in which a short circuit is established among all lines instead of between adjoining lines as illustrated in FIG. 5 to effect the charge sharing function. Such source driver IC has the NOSW 21 provided between the 2n+1 output buffer 15 and the 2(n+1) output buffer 15 shown in FIG. 5. In this type of source driver IC, it is impossible to minutely control the source holding potential $V_{SB}$ in the horizontal direction of the liquid crystal display device. Yet a typical liquid crystal display device includes a plurality of source driver ICs, without performing charge sharing among the source driver ICs. So the source holding potential $V_{SB}$ will vary at least with source driver ICs. In all cases, it is required that the number of source lines applied with data of positive polarity and the number of source lines applied with data of negative polarity be almost equal in a group of source lines that performs charge sharing.

A source holding potential $V_{SB}$ set in order to compensate for the change in feed-through voltage ($\Delta V_{CGD}$) shown in FIG. 9 may be predetermined by numerical calculation or by real adjustments when a vertical blanking interval and other intervals have been uniquely determined. When a vertical blanking interval or one vertical period is unknown (these may vary in a certain range), however, a source holding potential $V_{SB}$ to be set cannot be predetermined. In such cases, optimum source holding potentials $V_{SB}$ for several vertical blanking intervals and one vertical periods are determined and stored in a table. This allows an applicable optimum source holding potentials $V_{SB}$ to be obtained by detecting the vertical blanking interval and one vertical period during the actual operation of the liquid crystal display device.

Figure 11:
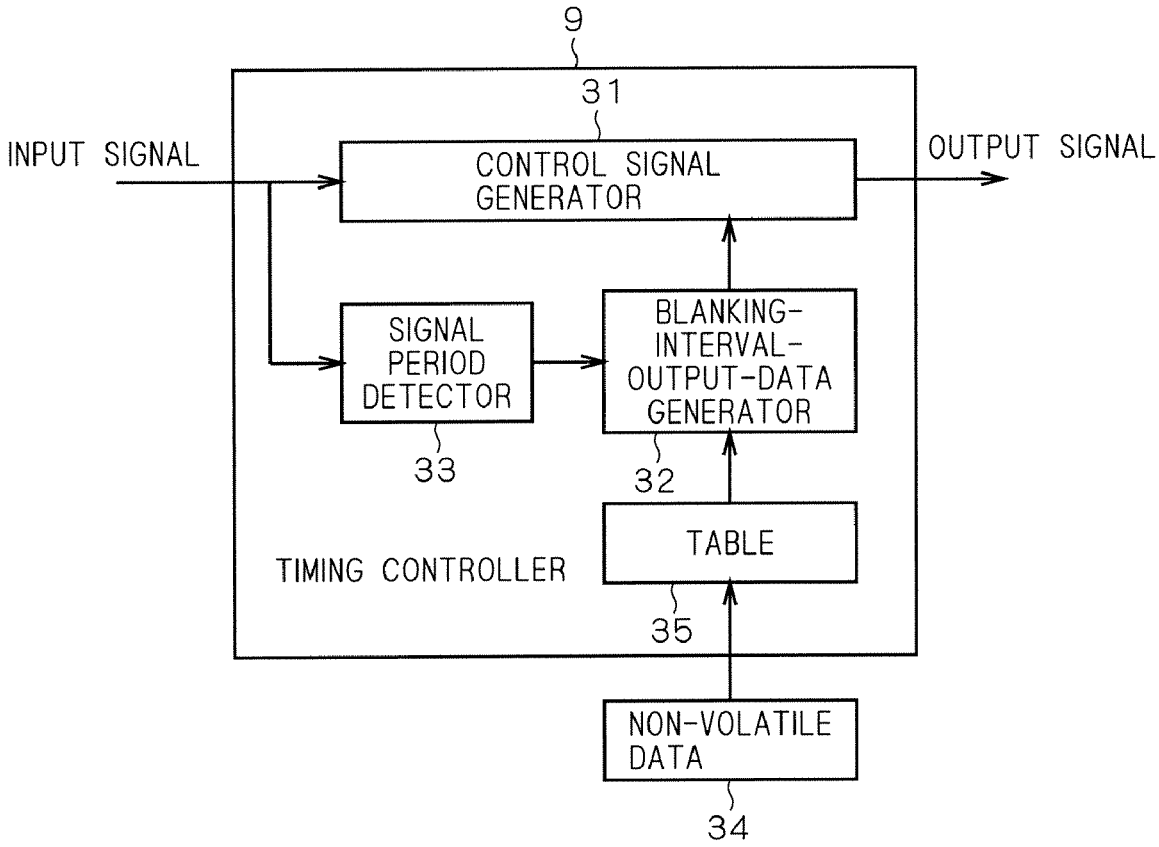
FIG. 11 is a block diagram of a timing controller according to the second preferred embodiment of the present invention.

FIG. 11 is a block diagram of the structure of the timing controller 9 that executes the above method. A control signal generator 31 in FIG. 11 has function as a typical timing controller, and also the function of generating the control signal (latch signal LP) to effect the charge sharing function by outputting data predetermined during the vertical blanking interval. The data predetermined during the vertical blanking interval is input to the control signal generator 31 from a blanking-interval-output-data generator 32. In the FIG. 11 example, a signal period detector 33 detects the vertical blanking interval or one vertical period from an input signal, and the blanking-interval-output-data generator 32 selects a plurality of tables 35 loaded from a non-volatile memory 34 based on the detection result, to determine the predetermined data.

When the data stored in the table 35 are discretized, a linear interpolation method and the like may be used between the data. The structure illustrated in FIG. 11 may be used to vary the source holding potential $V_{SB}$ in the horizontal direction of the liquid crystal display device according to this embodiment, and is also applicable to the first preferred embodiment.

In addition to the compensation for the feed-through voltage ($\Delta V_{CGD}$) described above, the method according to this embodiment is of course applicable to compensation for deviation of pixel potential resulting from other factors that vary in the horizontal direction of the liquid crystal display device. That is, deviation of a DC component of pixel potential in the horizontal direction of the liquid crystal display device can be suppressed only by the appropriate generation of a signal from the timing controller 9.

While the invention has been shown and described in detail, the foregoing description is in all aspects illustrative and not restrictive. It is therefore understood that numerous modifications and variations can be devised without departing from the scope of the invention.

What is claimed is:

1. A liquid crystal display device comprising:

pixels arranged in a matrix on a translucent substrate;

gate lines and source lines provided in a corresponding manner to said pixels;

an active element at an intersection of each of said gate lines and each of said source lines, said active element having a drain electrode connected to said pixel;

a gate driver circuit supplying a gate signal to said gate lines;

a source driver circuit supplying source signals to said source lines so that source signals having a positive polarity voltage relative to a common potential of said pixels and source signals having a negative polarity voltage relative to said common potential are almost equal in number during one horizontal interval; and a timing controller circuit supplying prescribed signals to said gate driver circuit and said source driver circuit to control said circuits, wherein a vertical blanking interval includes: a setting data output interval, a short circuit interval after said setting data output interval, and a holding interval after said short circuit interval, said source driver circuit, during said setting data output interval, conducts a prescribed operation of supplying each of said source signals of positive polarity and negative polarity with a prescribed voltage to said source lines to gradually change voltages of said source lines, said source driver circuit, during said short circuit interval, electrically cuts said source lines off from an output buffer of the source driver circuit after the supply of said source signals while establishing a short circuit between adjoining source lines of said source lines supplied with said source signals of opposite polarities thereby causing said source lines to gradually change to and then hold a source holding potential having a DC voltage value during said holding interval, and said source holding potential is set higher than said common potential of said pixels and lower than a source intermediate potential of said source signals of positive polarity and negative polarity.

2. The liquid crystal display device according to claim 1, wherein said source driver circuit repeats said prescribed operation a plurality of times during said vertical blanking interval.

3. The liquid crystal display device according to claim 1, wherein said source driver circuit sets said prescribed voltage of each of said source signals supplied during said vertical blanking interval so that said source holding potential for said source lines decreases by an amount having a direct relationship with a distance of said source lines from said gate driver.

4. The liquid crystal display device according to claim 3, wherein said source driver circuit sets said prescribed voltage of each of said source signals for each of said source lines, based on said distance from said gate driver, to decrease a pixel potential.

5. The liquid crystal display device according to claim 3, wherein said direct relationship is a linear relationship.

6. The liquid crystal display device according to claim 1, wherein said source driver circuit divides said source lines into groups so that source lines supplied with positive polarity voltage and said source lines supplied with negative polarity voltage of each group are almost equal in number, and said source driver circuit sets said prescribed voltage of each of said source signals supplied during said vertical blanking interval so that said source holding potential has a common value for source lines of a common group and so that said source holding potential decreases for said groups by an amount having a direct relationship with a distance from said gate driver.

7. The liquid crystal display device according to claim 6, wherein said source driver circuit sets said prescribed voltage of each of said source signals for each of said groups, based on said distance from said gate driver, to decrease a pixel potential.

8. The liquid crystal display device according to claim 6, wherein said direct relationship is a linear relationship.

9. The liquid crystal display device according to claim 1, wherein said timing controller circuit comprises a signal period detector for detecting a vertical period and said vertical blanking interval from an input signal, and a blanking-interval-output-data generator for generating said prescribed voltage of each of said source signals supplied during said vertical blanking interval based on a result of said signal period detector.

10. A method of driving a liquid crystal display device, said device comprising:

pixels arranged in a matrix on a translucent substrate;

gate lines and source lines provided in a corresponding manner to said pixels;

an active element at an intersection of each of said gate lines and each of said source lines, said active element having a drain electrode connected to said pixel;

a gate driver circuit supplying a gate signal to said gate lines;

a source driver circuit supplying source signals to said source lines so that source signals having a positive polarity voltage relative to a common potential of said pixels and source signals having a negative polarity voltage relative to said common potential are almost equal in number during one horizontal interval; and a timing controller circuit supplying prescribed signals to said gate driver circuit and said source driver circuit to control said circuits, wherein a vertical blanking interval includes: a setting data output interval, a short circuit interval after said setting data output interval, and a holding interval after said short circuit interval, said method comprising:

an output step of, during said setting data output interval, supplying each of said source signals of positive polarity and negative polarity with a prescribed voltage to said source lines by said source driver circuit to gradually change voltages of said source lines;

a short-circuit step of, during said short circuit interval, electrically cutting said source lines off from an output buffer of said source driver circuit after the supply of said source signals while establishing a short circuit between adjoining source lines of said source lines supplied with said source signals of opposite polarities after said output step; and a holding step, during said holding interval, of causing said source lines to hold a source holding potential having a DC voltage value after said short-circuit step, said source holding potential set higher than said common potential of said pixels and lower than a source intermediate potential of said source signals of positive polarity and negative polarity, wherein the short-circuit step and the holding step include causing said source lines to gradually change to and hold the source holding potential.

* * * * *